US010167160B2

(12) United States Patent
Zhang et al.

(10) Patent No.: US 10,167,160 B2
(45) Date of Patent: Jan. 1, 2019

(54) TEMPORARY PAPER MONEY STORAGE DEVICE AND CONTROL METHOD THEREOF

(71) Applicant: GRG BANKING EQUIPMENT CO., LTD., Guangzhou, Guangdong (CN)

(72) Inventors: Tao Zhang, Guangdong (CN); Zhiqiang Sun, Guangdong (CN); Hanfeng Xiao, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 104 days.

(21) Appl. No.: 15/527,858

(22) PCT Filed: Jul. 8, 2015

(86) PCT No.: PCT/CN2015/083511
§ 371 (c)(1),
(2) Date: May 18, 2017

(87) PCT Pub. No.: WO2016/095501
PCT Pub. Date: Jun. 23, 2016

(65) Prior Publication Data

US 2018/0350182 A1 Dec. 6, 2018

(30) Foreign Application Priority Data

Dec. 15, 2014 (CN) ..... 2014 1 0785017

(51) Int. Cl.
*B65H 29/00* (2006.01)
*G07D 11/00* (2006.01)
*B65H 43/00* (2006.01)

(52) U.S. Cl.
CPC ..... *B65H 29/006* (2013.01); *B65H 43/00* (2013.01); *G07D 11/0021* (2013.01);
(Continued)

(58) Field of Classification Search
CPC ..... B65H 29/006; B65H 2301/4191; B65H 2301/41912; B65H 2301/4452;
(Continued)

(56) References Cited

U.S. PATENT DOCUMENTS 5,104,109 A 4/1992 Kubo
5,894,937 A 4/1999 Schmidt
(Continued)

FOREIGN PATENT DOCUMENTS

CN 1130276 A 9/1996
CN 1576215 A 2/2005
(Continued)

OTHER PUBLICATIONS

International Search Report for PCT/CN2015/083511, dated Oct. 15, 2015, ISA/CN.
(Continued)

*Primary Examiner* — Jeremy R Severson
(74) *Attorney, Agent, or Firm* — U.S. Fairsky LLP; Yue (Robert) Xu

(57) ABSTRACT

A banknote temporary storage device includes: a timing unit, configured to obtain a time period between a time when the front end of a banknote enters into a first sensor and a time when the back end of the banknote leaves the first sensor; a calculating unit, configured to calculate a width of the banknote based on the time period, calculate a bump radius based on the width, and determine a condition of generating a bump on the storage coiling block; a detecting unit, configured to detect whether the condition of generating a bump on the storage coiling block is met, based on a real-time radius; and an interval control unit, configured to change an interval between banknotes on the storage coiling block in a pre-set control manner to eliminate a bump, in a case that the condition is met.

18 Claims, 4 Drawing Sheets

(52) U.S. Cl.
CPC ..... *G07D 11/0039* (2013.01); *B65H 2220/09* (2013.01); *B65H 2301/4191* (2013.01); *B65H 2301/41912* (2013.01); *B65H 2301/4452* (2013.01); *B65H 2511/12* (2013.01); *B65H 2511/166* (2013.01); *B65H 2511/22* (2013.01); *B65H 2553/41* (2013.01); *B65H 2701/1912* (2013.01); *G07D 2211/00* (2013.01)

(58) Field of Classification Search
CPC ..... B65H 2701/1912; B65H 2511/22; G07D 11/0021; G07D 2211/00
See application file for complete search history.

(56) References Cited

U.S. PATENT DOCUMENTS

| | | | | |
|---|---|---|---|---|
| 6,533,207 | B2 * | 3/2003 | Eugster | B65H 29/006 242/420.5 |
| 6,669,136 | B2 * | 12/2003 | Niioka | B65H 29/006 242/528 |
| 7,780,111 | B2 * | 8/2010 | Elbel | B65H 5/28 242/412.3 |
| 8,162,308 | B2 * | 4/2012 | Kobayashi | B65H 5/34 242/410 |
| 8,215,579 | B2 * | 7/2012 | Mizoro | B65H 29/006 242/528 |
| 8,636,274 | B2 * | 1/2014 | Ciampi | B65H 29/006 271/3.01 |
| 9,004,256 | B2 * | 4/2015 | Ohara | G07D 11/0084 194/200 |
| 9,342,944 | B2 * | 5/2016 | Amo | B65H 29/006 |
| 9,670,024 | B2 * | 6/2017 | Zhang | B65H 43/00 |
| 9,670,025 | B2 * | 6/2017 | Zhang | B65H 29/006 |
| 2005/0019075 | A1 | 1/2005 | Adachi et al. | |
| 2009/0134262 | A1 | 5/2009 | Elbel | |
| 2013/0081922 | A1 | 4/2013 | Amo | |
| 2016/0167913 | A1 | 6/2016 | Xiao et al. | |
| 2016/0304307 | A1 | 10/2016 | Zhang et al. | |
| 2016/0325959 | A1 * | 11/2016 | Chen | G05D 13/62 |

FOREIGN PATENT DOCUMENTS

| | | | |
|---|---|---|---|
| CN | 101331076 | A | 12/2008 |
| CN | 102930638 | A | 2/2013 |
| CN | 103395654 | A | 11/2013 |
| CN | 103617675 | A | 3/2014 |
| CN | 103676990 | A | 3/2014 |
| CN | 103754688 | A | 4/2014 |
| EP | 1970864 | A2 | 9/2008 |
| EP | 2104638 | A1 | 9/2009 |
| EP | 2306411 | A1 | 4/2011 |
| EP | 2104638 | B1 | 11/2016 |
| JP | H0295627 | A | 4/1990 |
| WO | 2008/087095 | A1 | 7/2008 |

OTHER PUBLICATIONS

Search Report dated Jul. 20, 2018 for European patent application No. 15869012.3, 5 pages.

* cited by examiner

TEMPORARY PAPER MONEY STORAGE DEVICE AND CONTROL METHOD THEREOF

CROSS REFERENCE TO RELATED APPLICATION

The present application is the national phase of International Application No. PCT/CN2015/083511, titled "TEMPORARY PAPER MONEY STORAGE DEVICE AND CONTROL METHOD THEREOF" filed on Jul. 8, 2015, which claims the priority to Chinese Patent Application No. 201410785017.2, titled "TEMPORARY PAPER MONEY STORAGE DEVICE AND CONTROL METHOD THEREOF", filed Dec. 15, 2014 with the State Intellectual Property Office of the People's Republic of China, both of which are incorporated herein by reference in their entireties.

TECHNICAL FIELD

The present disclosure relates to the field of financial self-service scrolling mechanism, and in particular to a banknote temporary storage device and a control method thereof.

BACKGROUND

In current financial self-service scrolling mechanisms, one of the most common methods for storing banknotes is to use a scrolling mechanism, such as a mechanism of a coiling block or a coiling tape. The scrolling mechanism of a banknote includes a banknote temporary storage unit driven by a first power motor, a spare tape coiling block driven by a second power motor. Two ends of a coiling tape are fixed at the banknote temporary storage unit and the spare tape coiling block respectively, to receive or release the wound coiling tapes by the banknote temporary storage unit and the spare tape coiling block. Both the first power motor and the second power motor are controlled by a micro-controller to start or stop. The operation mode of mutual coordination between the coiling block and the coiling tape is adopted in the storage scrolling mechanism to store and process banknotes.

A current method for controlling a banknote to enter into a scrolling mechanism is controlling a first power motor to start when the front end of a banknote enters into a first photoelectric sensor and stop when the back end of the banknote leaves a second photoelectric sensor, to bund banknotes entering into the scrolling mechanism continuously on a banknote temporary storage unit via coiling tapes at an equal interval.

However, this control method has the following disadvantages. It tends to make banknotes stack in the same position of the banknote temporary storage unit, and tends to form a bump when subsequent banknotes enter into the banknote temporary storage. For example, since a thickness of a banknote is small, a difference of perimeter between two adjacent rings of the banknote temporary storage unit is small. In this case, banknotes may stack in the same position of different rings of the banknote temporary storage unit, which forms a bump and thus forms an irregular circular in the banknote temporary storage unit, thereby causing technical problems of instability and malfunction when the scrolling mechanism receives or outputs banknotes.

SUMMARY

A banknote temporary storage device and a control method thereof are provided according to embodiments of the present disclosure, to solve technical problems of instability and malfunction when a scrolling mechanism receives or outputs banknotes, which is caused by an irregular circular formed in the banknote temporary storage unit due to a bump formed in the banknote temporary storage unit.

A banknote temporary storage device is provided according to an embodiment of the disclosure, which includes: a storage coiling block driven by a motor, a first sensor, a second sensor and a conveying passage, where the first sensor is arranged at an entrance of the banknote temporary storage device and configured to detect whether there is a banknote entering into the banknote temporary storage device, the second sensor is arranged between the first sensor and the storage coiling block and configured to detect whether a banknote completely enters into the banknote temporary storage device, and the conveying passage is located between the first sensor and the second sensor and configured to convey banknotes to the banknote temporary storage device at a constant speed V.

The banknote temporary storage device further includes:

a timing unit, configured to obtain a time period $\Delta t1$ between a time when the front end of a banknote enters into the first sensor and a time when the back end of the banknote leaves the first sensor;

a calculating unit, configured to calculate a width W of the banknote based on the time period $\Delta t1$ obtained by the timing unit, calculate a bump radius $R_{bump}$ of the storage coiling block where a bump is to be generated, based on the width W, and determine a condition of generating a bump on the storage coiling block based on the bump radius $R_{bump}$;

a detecting unit, configured to detect whether the condition of generating a bump on the storage coiling block is met, based on a real-time radius $R_{real\text{-}time}$ of the storage coiling block; and an interval control unit, configured to change an interval d between banknotes on the storage coiling block in a pre-set control manner to eliminate a bump, in a case that the detecting unit detects that the condition of generating a bump on the storage coiling block is met.

Preferably, the calculating unit is configured to calculate the width W of the banknote as $W=V\times\Delta t1$, calculate the bump radius $R_{bump}$ as $R_{bump}=(W+d)\times N/2\pi$, and determine the condition of generating a bump on the storage coiling block as $R_{real\text{-}time}=R_{bump}$, based on the bump radius $R_{bump}$, where N is a positive integer.

Preferably, the calculating unit is configured to calculate the width W of the banknote as $W=V\times\Delta t1$, calculate the bump radius $R_{bump}$ as $R_{bump}=(W+d)\times N/2\pi$, and determine the condition of generating a bump on the storage coiling block as $(R_{bump}-\Delta R)<R_{real\text{-}time}<(R_{bump}+\Delta R)$, based on the bump radius $R_{bump}$, where N is a positive integer, and $\Delta R$ is a pre-set multiple of a thickness of a banknote.

Preferably, the interval control unit is configured to change the interval d between banknotes on the storage coiling block to be greater than d in the pre-set control manner to eliminate the bump, in a case that the detecting unit detects that the condition of generating a bump on the storage coiling block is met.

Preferably, the interval control unit is configured to change the interval d between banknotes on the storage coiling block to be greater than d in the pre-set control manner to eliminate the bump by:

delaying, by the interval control unit, stop of the motor for a time period $\Delta t2$, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

A control method of a banknote temporary storage device is provided according to an embodiment of the disclosure, where an interval between banknotes on a storage coiling block is set as d, a conveying passage in the banknote temporary storage device conveys banknotes to a banknote temporary storage device at a constant speed V, and while entering into the temporary storage device, each of the banknotes first passes through a first sensor arranged outside the banknote temporary storage device to enter into the temporary storage device and then passes through a second sensor. The method includes:

S1, obtaining a time period $\Delta t1$ between a time when the front end of a banknote enters into a first sensor and a time when the back end of the banknote leaves the first sensor;

S2, calculating a width W of the banknote based on the time period $\Delta t1$, calculating a bump radius $R_{bump}$ of the storage coiling block where a bump is to be generated, based on the width W, and determining a condition of generating a bump on the storage coiling block based on the bump radius $R_{bump}$;

S3, calculating a real-time radius $R_{real\text{-}time}$ of the storage coiling block;

S4, determining whether the condition of generating a bump on the storage coiling block is met, based on the real-time radius $R_{real\text{-}time}$ of the storage coiling block; and S5, changing an interval d between banknotes on the storage coiling block in a pre-set control manner to eliminate the bump, in a case that a determination result of S4 is positive.

Preferably, S2 includes:

calculating the width W of the banknote $W=V\times\Delta t1$, then calculating the bump radius $R_{bump}$ as $R_{bump}=(W+d)\times N/2\pi$, and determining the condition of generating a bump on the storage coiling block as $R_{real\text{-}time}=R_{bump}$, based on the bump radius $R_{bump}$, where N is a positive integer.

Preferably, S2 includes:

calculating the width W of the banknote as $W=V\times\Delta t1$, calculating the bump radius $R_{bump}$ as $R_{bump}=(W+d)\times N/2\pi$, and determining the condition of generating a bump on the storage coiling block as $(R_{bump}-\Delta R)<R_{real\text{-}time}<(R_{bump}+\Delta R)$, based on the bump radius $R_{bump}$, where N is a positive integer, and $\Delta R$ is a pre-set multiple of a thickness of a banknote.

Preferably, S5 includes:

changing the interval d between banknotes on the storage coiling block to be greater than d in the pre-set control manner to eliminate the bump, in a case that the determination result of S4 is positive.

Preferably, the changing the interval d between banknotes on the storage coiling block to be greater than d in the pre-set control manner to eliminate the bump in S5 includes:

delaying stop of a motor for a time period $\Delta t2$, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

It can be seen from the above technical solutions that the embodiments of the present disclosure have the following advantages.

The banknote temporary storage device and the control method thereof are provided according to the embodiments of the present disclosure. The banknote temporary storage device includes: a storage coiling block driven by a motor, a first sensor, a second sensor and a conveying passage, where the first sensor is arranged at an entrance of the banknote temporary storage device and configured to detect whether there is a banknote entering into the banknote temporary storage device, the second sensor is arranged between the first sensor and the storage coiling block and configured to detect whether a banknote completely enters into the banknote temporary storage device, and the conveying passage is located between the first sensor and the second sensor and configured to convey banknotes to the banknote temporary storage device at a constant speed V. The banknote temporary storage device further includes: a timing unit, configured to obtain a time period time $\Delta t1$ between a time when the front end of a banknote enters into the first sensor and a time when the back end of the banknote leaves the first sensor; a calculating unit, configured to calculate a width W of the banknote based on the time period $\Delta t1$ obtained by the timing unit, then calculate a bump radius $R_{bump}$ of the storage coiling block where a bump is to be generated, based on the width W, and determine a condition of generating a bump on the storage coiling block based on the bump radius $R_{bump}$; a detecting unit, configured to detect whether the condition of generating a bump on the storage coiling block is met based on a real-time radius $R_{real\text{-}time}$ of the storage coiling block; and an interval control unit, configured to change an interval d between banknotes on the storage coiling block in a pre-set control manner to eliminate the bump, in a case that the detecting unit detects that the condition of generating a bump on the storage coiling block is met. In the embodiments, the timing unit first obtains the time period $\Delta t1$ for the back end of the banknote leaving the first sensor, then the calculating unit calculates a bump radius $R_{bump}$ of the storage coiling block where a bump is to be generated, based on a width of the banknote obtained based on $\Delta t1$, to determine a condition of generating a bump on the storage coiling block, such that the detecting unit determines whether a bump is generated according to the condition, and finally the interval control unit changes an interval d between banknotes on the storage coiling block in the pre-set control manner to eliminate the bump if it is detected that the bump is generated, thereby solving the technical problem of instability and malfunction when a scrolling mechanism dispenses or receives or outputs banknotes, which is caused by an irregular circular formed in the banknote temporary storage unit due to a bump formed in the banknote temporary storage unit.

BRIEF DESCRIPTION OF THE DRAWINGS

To illustrate technical solutions according to embodiments of the present disclosure or in the conventional technologies more clearly, drawings to be used in the descriptions of the conventional technologies or the embodiments are described briefly hereinafter. Apparently, the drawings described hereinafter are only for some embodiments of the present disclosure, and other drawings may be obtained by those skilled in the art based on those drawings without creative efforts.

DETAILED DESCRIPTION OF THE EMBODIMENTS

A banknote temporary storage device and a control method thereof are provided according to embodiments of the disclosure, for solving technical problems of instability and malfunction when the scrolling mechanism receives or outputs banknotes, which is caused by an irregular circular formed in the banknote temporary storage unit due to a bump formed in the banknote temporary storage unit.

In order to make objects, features and advantages of the present disclosure clearer and easier to understand, hereinafter technical solutions of embodiments of the present disclosure are illustrated clearly and completely in conjunction with drawings of the embodiments of the disclosure. Apparently, the described embodiments are merely a few rather than all of the embodiments of the present disclosure. All other embodiments obtained by persons of ordinary skill in the art based on the embodiments of the present disclosure without creative efforts shall fall within the protection scope of the present disclosure.

Figure 1:
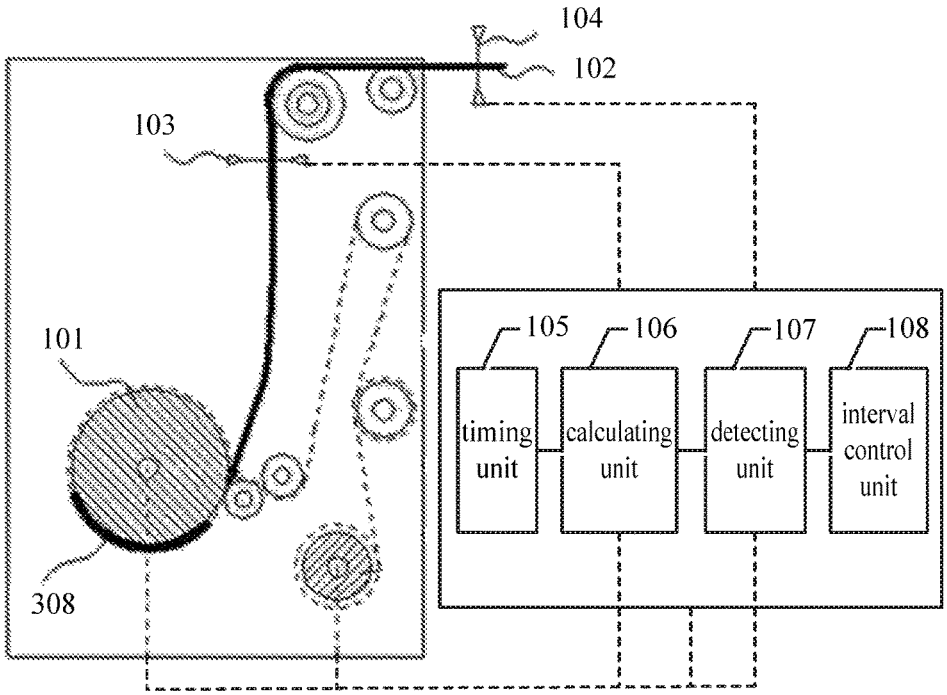
FIG. 1 is a schematic structural diagram of a banknote temporary storage device according to an embodiment of the present disclosure.
Figure 2:
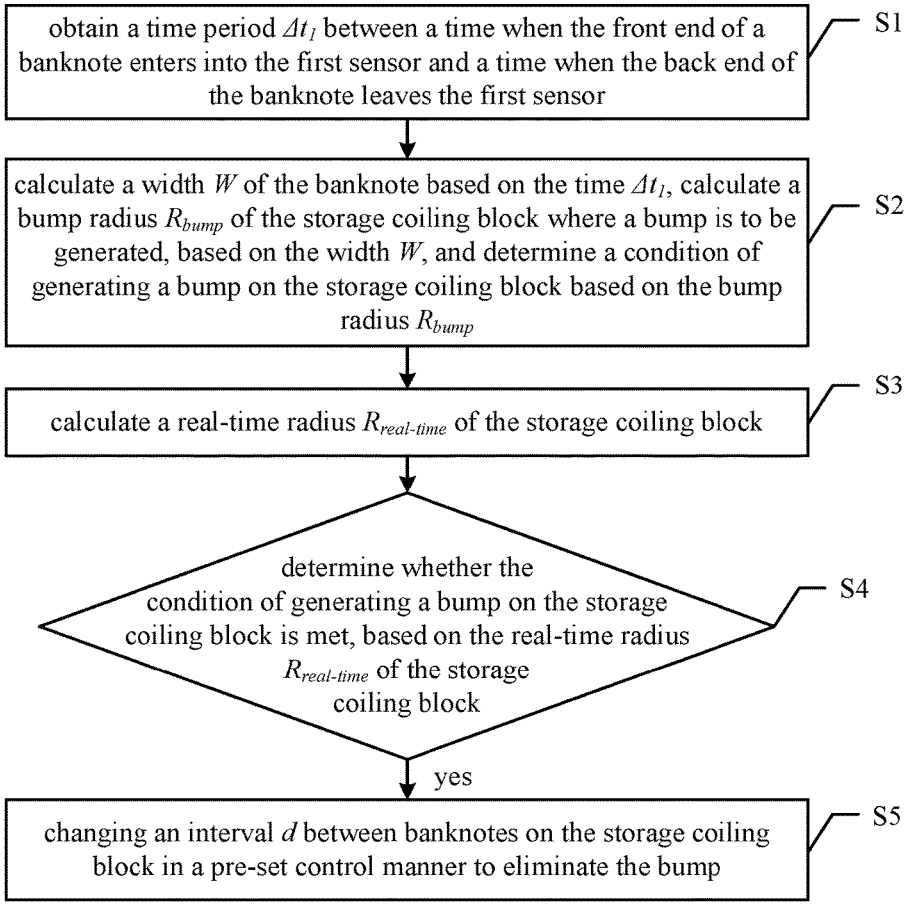
FIG. 2 is a schematic flow chart of a control method of a banknote temporary storage device according to an embodiment of the present disclosure.

Reference is made to FIG. 1 and FIG. 2. A banknote temporary storage device provided according to an embodiment of the present disclosure includes: a storage coiling block 101 driven by a motor, a first sensor 104, a second sensor 103 and a conveying passage 102. The first sensor 104 is arranged at an entrance of the banknote temporary storage device and configured to detect whether there is a banknote entering into the banknote temporary storage device. The second sensor 103 is arranged between the first sensor 104 and the storage coiling block 101 and configured to detect whether a banknote completely enters into the banknote temporary storage device. The conveying passage is located between the first sensor 104 and the second sensor 103 and configured to convey banknotes to the banknote temporary storage device at a constant speed V.

The banknote temporary storage device according to the embodiment of the present disclosure further includes a timing unit 105, a calculating unit 106, a detecting unit 107 and an interval control unit 108.

The timing unit 105 is configured to obtain a time period $\Delta t1$ between a time when the front end of a banknote enters into the first sensor 104 and a time when the back end of the banknote leaves the first sensor 104.

The calculating unit 106 is configured to calculate a width W of the banknote based on the time period $\Delta t1$ obtained by the timing unit 105, then calculate a bump radius $R_{bump}$ of the storage coiling block 101 where a bump is to be generated, based on the width W, and determine a condition of generating a bump on the storage coiling block 101 based on the bump radius $R_{bump}$.

The detecting unit 107 is configured to detect whether the condition of generating a bump on the storage coiling block 101 is met, based on a real-time radius $R_{real\text{-}time}$ of the storage coiling block 101.

The interval control unit 108 is configured to change an interval d between banknotes on the storage coiling block 101 in a pre-set control manner to eliminate a bump, in a case that the detecting unit detects that the condition of generating a bump on the storage coiling block 101 is met.

Further, the above width W calculated by the calculating unit 105 may be calculated as $W=V\times\Delta t1$, and then the calculating unit 105 calculates the bump radius $R_{bump}$ as $R_{bump}=(W+d)\times N/2\pi$. The condition of generating a bump on the storage coiling block 101 may be determined by the calculating unit 105 in multiple manners, which are respectively described below in detail.

In a first manner, the condition of generating a bump on the storage coiling block 101 is determined by the calculating unit 105 based on bump radius $R_{bump}$ as $R_{real\text{-}time}=R_{bump}$, where N is a positive integer.

In a second manner, the condition of generating a bump on the storage coiling block 101 is determined by the calculating unit 105 based on the bump radius $R_{bump}$ as $(R_{bump}-\Delta R)<R_{real\text{-}time}<(R_{bump}+\Delta R)$, where N is a positive integer, and $\Delta R$ is a pre-set multiple of a thickness of a banknote.

Further, the above interval control unit 108 changes the interval d between banknotes on the storage coiling block 101 to be greater than d in the pre-set control manner to eliminate the bump, in a case that the detecting unit detects that the condition of generating a bump on the storage coiling block 101 is met.

It may be understood that, the detailed process of changing by the interval control unit 108 the interval d between banknotes on the storage coiling block 101 to be greater than din the pre-set control manner to eliminate the bump may be performed as delaying, by the interval control unit 108, the stop of the motor for a time period $\Delta t2$, from the time when the second sensor 103 detects that the back end of a banknote leaves the second sensor, to change the interval d between banknotes on the storage coiling block 101 to 2d to eliminate the bump, where $\Delta t2=d/V_{constant\text{-}speed}$, and $V_{constant\text{-}speed}$ denotes a constant rotation linear speed of the storage coiling block 101. It should be noted that, the interval d between banknotes on the storage coiling block 101 may be changed into an appropriate value greater than d based on actual parameters of the device. The above first sensor 104 and the second sensor 103 may be photoelectric sensors, which are not limited herein.

In the embodiment, the timing unit 105 first obtains the time period $\Delta t1$ for the back end of the banknote leaving the first sensor 104, then the calculating unit 106 calculates a bump radius $R_{bump}$ of the storage coiling block 101 where a bump is to be generated, based on a width of the banknote obtained based on $\Delta t1$, to determine a condition of generating a bump on the storage coiling block 101, such that the detecting unit 107 determines whether a bump is generated according to the condition, and finally the interval control unit 108 changes an interval d between banknotes on the storage coiling block 101 in the pre-set control manner to eliminate the bump if it is detected that the bump is generated, thereby solving technical problems of instability and malfunction when the scrolling mechanism receives or outputs banknotes, which is caused by an irregular circular formed in the banknote temporary storage unit due to a bump formed in the banknote temporary storage unit.

Reference is made to FIG. 2. A control method of a banknote temporary storage device is provided according to an embodiment of the present disclosure as follows.

An interval between banknotes on the storage coiling block 101 shown in FIG. 1 is set as d. A conveying passage in the banknote temporary storage device conveys banknotes to a banknote temporary storage device at a constant speed V. While entering into the temporary storage device, the banknote first passes through the first sensor 104 arranged outside the banknote temporary storage device to enter into the temporary storage device and then passes through the second sensor 103. The control method in the embodiment includes steps S1 to S5.

In step S1, a time period Δt1 between a time when the front end of a banknote enters into a first sensor and a time when the back end of the banknote leaves the first sensor is obtained.

In the embodiment, the time period Δt1 between a time when the front end of a banknote enters into the first sensor and a time when the back end of the banknote leaves the first sensor needs to be firstly obtained.

In step S2, a width W of the banknote is calculated based on the time period Δt1, then a bump radius $R_{bump}$ of a storage coiling block is calculated based on the width W, and the condition of generating a bump on the storage coiling block $R_{bump}$ is determined based on the bump radius.

After obtaining the time period Δt1 between a time when the front end of a banknote enters into the first sensor and a time when the back end of the banknote leaves the first sensor, the width W of the banknote needs to be calculated based on the time period Δt1, then a bump radius $R_{bump}$ of a storage coiling block is calculated based on the width W, and the condition of generating a bump on the storage coiling block is determined based on the bump radius $R_{bump}$. It is understood that how to determine the condition of generating a bump will be described in detailed in a next embodiment, which is not described herein.

In step S3, a real-time radius $R_{real\text{-}time}$ of the storage coiling block is calculated.

After calculating the width W of the banknote based on the time period Δt1, then calculating the bump radius $R_{bump}$ of the storage coiling block where a bump is to be generated based on the width W, and determining the condition of generating a bump on the storage coiling block based on the bump radius $R_{bump}$, the real-time radius $R_{real\text{-}time}$ of the storage coiling block is calculated.

In step S4, it is determined whether the condition of generating a bump on the storage coiling block is met based on the real-time radius $R_{real\text{-}time}$ of the storage coiling block.

Here, it needs to determine whether the condition of generating a bump on the storage coiling block is met based on the real-time radius $R_{real\text{-}time}$ of the storage coiling block.

In step S5, an interval d between banknotes on the storage coiling block is changed in a pre-set control manner to eliminate the bump, in a case of a positive determination result in S4.

In a case that the determination result of S4 is positive, the interval d between banknotes on the storage coiling block is changed in the pre-set control manner to eliminate the bump. It should be noted that, the above pre-set control manner will be described in detail in a next embodiment, which is not described herein.

Figure 4:
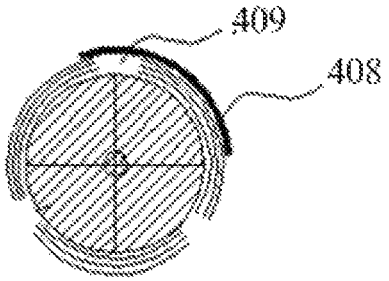
FIG. 4 is a schematic structural diagram of principles of a scrolling mechanism generating a bump according to an embodiment of the present disclosure.

It should be noted that, FIG. 4 is a schematic structural diagram of principles of a scrolling mechanism generating a bump according to an embodiment of the present disclosure. As for a storage coiling block storing banknotes, in a case that a perimeter L of the storage coiling block is an integer multiple (which is 3 as shown in FIG. 4) of the sum of a width $W_{banknote}$ and an interval $d_{banknote}$ between banknotes, banknotes 408 are stacked together in different rings and forms a notch 409. When subsequent banknotes 408 enter and are wound around the notch 409, they sink because there is no support at the bottom, which forms a bump at both sides of the notch 409. If a perimeter of the storage coiling block satisfies the following relation, the case that banknotes 408 stack to form a notch 409 will occur.

In the embodiment, the time period time Δt1 for the back end of the banknote leaveing the first sensor is first obtained, then a bump radius $R_{bump}$ of the storage coiling block where a bump is to be generated is calculated based on a width of the banknote obtained based on Δt1, to determine a condition of generating a bump on the storage coiling block, such that whether a bump is generated is determined according to the condition; and finally an interval d between banknotes on the storage coiling block is changed in the pre-set control manner to eliminate the bump after detecting that the bump is generated, thereby solving technical problems of instability and malfunction when the scrolling mechanism receives or outputs banknotes, which is caused by an irregular circular formed in the banknote temporary storage unit due to a bump formed in the banknote temporary storage unit.

Figure 3:
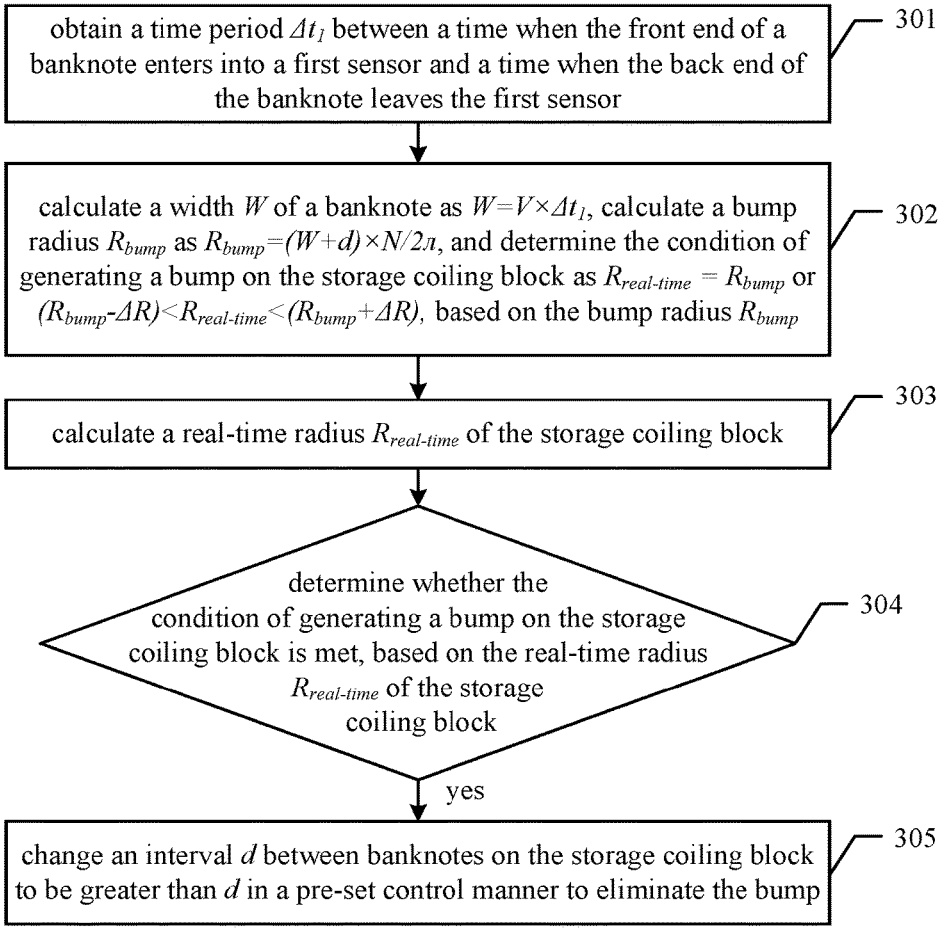
FIG. 3 is a schematic flow chart of a control method of a banknote temporary storage device according to another embodiment of the present disclosure.

In the above, the processes of the control method of a banknote temporary storage device are described in detail, and hereinafter how to determine a condition of generating a bump will be described in detail. Reference is made to FIG. 3. Another embodiment of the control method of a banknote temporary storage device according to the embodiment of the present disclosure is described as follows.

An interval between banknotes on the storage coiling block 101 shown in FIG. 1 is set as d. A conveying passage in the banknote temporary storage device conveys banknotes to a banknote temporary storage device at a constant speed V. While entering into the temporary storage device, the banknote first passes through a first sensor 104 arranged outside the banknote temporary storage device to enter into the temporary storage device and then passes through a second sensor 103. The control method in the embodiment includes steps S301 to S305.

In step 301, a time period Δt1 between a time when the front end of a banknote enters into a first sensor and a time when the back end of the banknote leaves the first sensor is obtained.

In the embodiment, the time period Δt1 between a time when the front end of a banknote enters into a first sensor and a time when the back end of the banknote leaves the first sensor needs to be firstly obtained.

In step S302, a width W of the banknote is calculated as $W=V\times\Delta t1$, then a bump radius $R_{bump}$ is calculated as $R_{bump}=(W+d)\times N/2\pi$, and the condition of generating a bump on the storage coiling block is determined as $R_{real\text{-}time}=R_{bump}$ or $(R_{bump}-\Delta R)<R_{real\text{-}time}<(R_{bump}+\Delta R)$, based on the bump radius $R_{bump}$.

After obtaining the time period Δt1 between a time when the front end of a banknote enters into a first sensor and a time when the back end of the banknote leaves the first sensor, the width W of the banknote needs to be calculated based on the time period Δt1. Then the bump radius $R_{bump}$ is calculated as $R_{bump}=(W+d)\times N/2\pi$, and the condition of generating a bump on the storage coiling block is determined as $R_{real\text{-}time}=R_{bump}$ or $(R_{bump}-\Delta R)<R_{real\text{-}time}<(R_{bump}+\Delta R)$ based on the bump radius $R_{bump}$, where N is a positive integer, and ΔR is a pre-set multiple of a thickness of a banknote.

In step S303, a real-time radius $R_{real\text{-}time}$ of the storage coiling block is calculated.

After calculating the width W of the banknote based on the time period Δt1, then calculating the bump radius $R_{bump}$ as $R_{bump}=(W+d)\times N/2\pi$, and determining the condition of generating a bump on the storage coiling block as $R_{real\text{-}time}=R_{bump}$ or $(R_{bump}-\Delta R)<R_{real\text{-}time}<(R_{bump}+\Delta R)$ based on the bump radius $R_{bump}$, the real-time radius $R_{real\text{-}time}$ of the storage coiling block is calculated.

In step S304, it is determined whether the condition of generating a bump on the storage coiling block is met, based on the real-time radius $R_{real\text{-}time}$ of the storage coiling block.

Here, it needs to determine whether the condition of generating a bump on the storage coiling block is met, based on the real-time radius $R_{real\text{-}time}$ of the storage coiling block.

In step S305, an interval d between banknotes on the storage coiling block is changed to be greater than d in a pre-set control manner to eliminate the bump, in a case that a determination result of S4 is positive.

In a case that the determination result of S4 is positive, the interval d between banknotes on the storage coiling block is changed to be greater than d in the pre-set control manner to eliminate the bump. It should be noted that, the detail process of the changing the interval d between banknotes on the storage coiling block to be greater than d in the pre-set control manner to eliminate the bump described in the above is: delaying the stop of a motor for a time period Δt2, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

It should be noted that, FIG. 4 is a schematic structural diagram of principles of a scrolling mechanism generating a bump according to an embodiment of the present disclosure. As for a storage coiling block storing banknotes, in a case that a perimeter L of the storage coiling block is an integer multiple (which is 3 as shown in FIG. 4) of the sum of a width $W_{banknote}$ and an interval $d_{banknote}$ of a banknote, banknotes 408 are stacked together in different rings to form a notch 409. When subsequent banknotes 408 enter and are wound around the notch 409, they sink because there is no support at the bottom, which forms a bump at both sides of the notch 409. If a perimeter of the storage coiling block satisfies the following relation, a case that banknotes 408 stack to form a notch 409 will occur.

In the embodiment, the time period Δt1 for the back end of the banknote leaving the first sensor is first obtained, then a bump radius $R_{bump}$ of the storage coiling block where a bump is to be generated is calculated based on a width of the banknote obtained based on Δt1, and a condition of generating a bump on the storage coiling block is determined, so as to determine whether a bump is generated according to the condition, and finally an interval d between banknotes on the storage coiling block is changed in the pre-set control manner to eliminate the bump after detecting that the bump is generated, thereby solving the technical problems of instability and malfunction when the scrolling mechanism receives or outputs banknotes, which is caused by an irregular circular formed in the banknote temporary storage unit due to a bump formed in the banknote temporary storage unit. In addition, after detecting that a real-time radius of the bump satisfies the condition of generating a bump, the interval d between banknotes on the storage coiling block is adjusted to be of an appropriate value greater than d, such as 1.5d, 2d, 3d, thereby more accurately avoiding the technical problems of instability and malfunction when the scrolling mechanism receives or outputs banknotes.

For better understanding, hereinafter a specific application scenarios of the method for controlling a scrolling mechanism according to the embodiment as shown in FIG. 1 is described in detail, in which condition of generating a bump on a banknote temporary storage device is $(R_{bump}-\Delta R)<R_{real\text{-}time}<(R_{bump}+\Delta R)$.

It is assumed that an interval between banknotes 108 on a storage coiling block 101 is controlled to be d=30 mm, a speed of an exterior passage of a banknote temporary storage device is the same as a constant speed of the storage coiling block 101, both of which are $V_0$=0.8 mm/ms, a radius of the storage coiling block 101 varies in a range of 30 mm to 60 mm, a width of the banknote 308 is $W_{banknote}$=70 mm, a thickness of the banknote is 0.1 mm. In this case, a location where a bump is generated may be calculated as $L_{bump}=(W_{banknote}+d_{banknote})*N$ (where N is a positive integer). Since $L_{bump}$ is in the range of (2π*30 mm, 2π*20 mm), N may have two values of 2 and 3. Taking N=3 as an example, there is $r_{bump}=(W_{banknote}+d_{banknote})*3/2\pi\approx47.7$ mm, Δr=10*0.1 mm=1 mm (here the thickness of the banknote is 0.1 mm), and $\Delta t1=d_{banknote}/V_0$=30/0.8 ms=37.5 ms. That is, if a real-time radius $r_{real\text{-}time}$ of the banknote temporary storage unit 301 is detected to be in a range of $(R_{bump}-\Delta r, R_{bump}+\Delta r)$, namely, a range of (46.7 mm, 48.7 mm), a stop condition of the first banknote 308 of every three banknotes entering into the device is changed, i.e., a first power motor is stopped after 37.5 ms from the time when the back end of the banknote leaves the second photoelectric sensor.

It is clearly understood by those skills in the art that, for convenience and brevity of description, reference may be made to corresponding processes of the above embodiments of the method for details of operating processes of the above systems, devices and units, which are not repeated herein.

It should be understood that, the disclosed systems, devices and methods in the embodiments according to the present disclosure may be implemented in other manners. For example, the above embodiments of the device are only illustrative. For example, the units are divided only based on logical functions, and there are other dividing modes in practical implementations. For example, multiple units or components may be combined or integrated into another system, or some features may be ignored or not be executed. In addition, the shown or discussed coupling or direct coupling or communication connection may be indirect coupling or communication connection via some interfaces, devices or units, and may be electrical, mechanical or other forms.

Units illustrated as separation components may or may not be separated physically. A component shown as a unit may or may not be a physical unit, that is, may be located in a same position, or may be distributed to multiple network units. A part of or all of units may be selected as required to implement objects of the technical solutions according to the embodiments.

In addition, various function units according to various embodiments of the present disclosure may be integrated into one processing unit, or may exist independently, or two or more than two of the above units may be integrated into one unit. The above integrated units may be implemented in a form of hardware, or in a form of a software function unit.

The integrated unit may be stored in a readable storage medium of a computing device, if the functions are implemented in a form of a soft function unit and sold or used as an independent product. Based on this understanding, the part of the technical solutions according to the present disclosure which is essential or contributes to the conventional technology, or all or some of the technical solutions can be embodied in a form of a software product. The computer software product is stored in a storage medium, which includes several instructions used for a rolling mechanism of a computing device (may be a rolling mechanism of a personal computer, a server, or a network device) to execute all or some of steps described in various embodiments of the present disclosure. The storage medium in the forgoing includes various media which can store program codes, such as, a USB disk, a removable hard disk, a read-only memory (ROM), a random access memory (RAM), a magnetic disk, or an optical disk.

As described above, the above embodiments are only to illustrate the technical solutions of the present disclosure, but not to limit the present disclosure. Although the present disclosure is illustrated in detail with reference to the above embodiments, it should be understood by those skilled in the art that, the technical solutions according to the above embodiments may be modified, or some technical features in the technical solutions may be substituted by equivalents. Those modifications or substitutes do not make the essence of the technical solutions departing from the spirit and scope of the technical solutions according to the embodiments of the present disclosure.

The invention claimed is:

1. A banknote temporary storage device, comprising:

a storage coiling block driven by a motor, a first sensor, a second sensor and a conveying passage, wherein the first sensor is arranged at an entrance of the banknote temporary storage device, and configured to detect whether there is a banknote entering into the banknote temporary storage device;

the second sensor is arranged between the first sensor and the storage coiling block, and configured to detect whether a banknote completely enters into the banknote temporary storage device; and the conveying passage is located between the first sensor and the second sensor, and configured to convey banknotes to the banknote temporary storage device at a constant speed V, wherein the banknote temporary storage device further comprises:

a timing unit, configured to obtain a time period $\Delta t1$ between a time when the front end of a banknote enters into the first sensor and a time when the back end of the banknote leaves the first sensor;

a calculating unit, configured to calculate a width W of the banknote based on the time period $\Delta t1$ obtained by the timing unit, calculate a bump radius $R_{bump}$ of the storage coiling block where a bump is to be generated, based on the width W, and determine a condition of generating a bump on the storage coiling block based on the bump radius $R_{bump}$;

a detecting unit, configured to detect whether the condition of generating a bump on the storage coiling block is met, based on a real-time radius $R_{real\text{-}time}$ of the storage coiling block; and an interval control unit, configured to change an interval d between banknotes on the storage coiling block in a pre-set control manner to eliminate a bump, in a case that the detecting unit detects that the condition of generating a bump on the storage coiling block is met.

2. The banknote temporary storage device according to claim 1, wherein the calculating unit is configured to calculate the width W of the banknote as $W=V\times\Delta t1$, calculate the bump radius $R_{bump}$ as $R_{bump}=(W+d)\times N/2\pi$, and determine the condition of generating a bump on the storage coiling block as $R_{real\text{-}time}=R_{bump}$, based on the bump radius $R_{bump}$, where N is a positive integer.

3. The banknote temporary storage device according to claim 2, wherein the interval control unit is configured to change the interval d between banknotes on the storage coiling block to be greater than d in the pre-set control manner to eliminate the bump, in a case that the detecting unit detects that the condition of generating a bump on the storage coiling block is met.

4. The banknote temporary storage device according to claim 3, wherein the interval control unit is configured to change the interval d between banknotes on the storage coiling block to be greater than d in the pre-set control manner to eliminate a bump by:

delaying, by the interval control unit, stop of the motor for a time period $\Delta t2$, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

5. The banknote temporary storage device according to claim 1, wherein the calculating unit is configured to calculate the width W of the banknote as $W=V\times\Delta t1$, calculate the bump radius $R_{bump}$ as $R_{bump}=(W+d)\times N/2\pi$, and determine the condition of generating a bump on the storage coiling block as $(R_{bump}-\Delta R)<R_{real\text{-}time}<(R_{bump}+\Delta R)$, based on the bump radius $R_{bump}$, where N is a positive integer, and $\Delta R$ is a pre-set multiple of a thickness of a banknote.

6. The banknote temporary storage device according to claim 5, wherein the interval control unit is configured to change the interval d between banknotes on the storage coiling block to be greater than d in the pre-set control manner to eliminate the bump, in a case that the detecting unit detects that the condition of generating a bump on the storage coiling block is met.

7. The banknote temporary storage device according to claim 6, wherein the interval control unit is configured to change the interval d between banknotes on the storage coiling block to be greater than d in the pre-set control manner to eliminate a bump by:

delaying, by the interval control unit, stop of the motor for a time period $\Delta t2$, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

8. The banknote temporary storage device according to claim 1, wherein the interval control unit is configured to change the interval d between banknotes on the storage coiling block to be greater than d in the pre-set control manner to eliminate the bump, in a case that the detecting unit detects that the condition of generating a bump on the storage coiling block is met.

9. The banknote temporary storage device according to claim 8, wherein the interval control unit is configured to change the interval d between banknotes on the storage coiling block to be greater than d in the pre-set control manner to eliminate a bump by:

delaying, by the interval control unit, stop of the motor for a time period $\Delta t2$, from the time when the second sensor detects that the back end of a banknote leaves the second sensor, to change the interval d between banknotes on the storage coiling block to 2d to eliminate the bump, where $\Delta t2=d/V_{constant\text{-}speed}$ , and $V_{constant\text{-}speed}$ denotes a constant rotation linear speed of the storage coiling block.

10. A control method of a banknote temporary storage device, wherein an interval between banknotes on a storage coiling block is set as d, a conveying passage in the banknote temporary storage device conveys banknotes to a banknote temporary storage device at a constant speed V, and while entering into the temporary storage device, each of the banknotes first passes through a first sensor arranged outside the banknote temporary storage device to enter into the temporary storage device and then passes through a second sensor;

the method comprises:

S1, obtaining a time period Δt1 between a time when the front end of a banknote enters into a first sensor and a time when the back end of the banknote leaves the first sensor;

S2, calculating a width W of the banknote based on the time period Δt1, calculating a bump radius $R_{bump}$ of the storage coiling block where a bump is to be generated based on the width W, and determining a condition of generating a bump on the storage coiling block based on the bump radius $R_{bump}$;

S3, calculating a real-time radius $R_{real\text{-}time}$ of the storage coiling block;

S4, determining whether the condition of generating a bump on the storage coiling block is met, based on the real-time radius $R_{real\text{-}time}$ of the storage coiling block; and S5, changing an interval d between banknotes on the storage coiling block in a pre-set control manner to eliminate a bump, in a case that a determination result of S4 is positive.

11. The control method of a banknote temporary storage device according to claim 10, wherein S2 comprises:

calculating the width W of the banknote as $W=V\times\Delta t1$, calculating the bump radius $R_{bump}$ as $R_{bump}=(W+d)\times N/2\pi$, and determining the condition of generating a bump on the storage coiling block as $R_{real\text{-}time}=R_{bump}$, based on the bump radius $R_{bump}$, where N is a positive integer.

12. The control method of a banknote temporary storage device according to claim 11, wherein S5 comprises:

changing the interval d between banknotes on the storage coiling block to be greater than d in the pre-set control manner to eliminate the bump, in a case that the determination result of S4 is positive.

13. The control method of a banknote temporary storage device according to claim 12, wherein the changing the interval d between banknotes on the storage coiling block to be greater than d in the pre-set control manner to eliminate the bump on S5 comprises:

delaying stop of a motor for a time period Δt2, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

14. The control method of a banknote temporary storage device according to claim 10, wherein S2 comprises:

calculating the width W of the banknote as $W=V\times\Delta t1$, calculating the bump radius $R_{bump}$ as $R_{bump}=(W+d)\times N/2\pi$, and determining the condition of generating a bump on the storage coiling block as $(R_{bump}-\Delta R)<R_{real\text{-}time}<(R_{bump}+\Delta R)$, based on the bump radius $R_{bump}$, where N is a positive integer, and ΔR is a pre-set multiple of a thickness of a banknote.

15. The control method of a banknote temporary storage device according to claim 14, wherein S5 comprises:

changing the interval d between banknotes on the storage coiling block to be greater than d in the pre-set control manner to eliminate the bump, in a case that the determination result of S4 is positive.

16. The control method of a banknote temporary storage device according to claim 15, wherein the changing the interval d between banknotes on the storage coiling block to be greater than d in the pre-set control manner to eliminate the bump on S5 comprises:

delaying stop of a motor for a time period Δt2, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

17. The control method of a banknote temporary storage device according to claim 10, wherein S5 comprises:

changing the interval d between banknotes on the storage coiling block to be greater than d in the pre-set control manner to eliminate the bump, in a case that the determination result of S4 is positive.

18. The control method of a banknote temporary storage device according to claim 17, wherein the changing the interval d between banknotes on the storage coiling block to be greater than d in the pre-set control manner to eliminate the bump on S5 comprises:

delaying stop of a motor for a time period Δt2, from the time when the second sensor detects that the back end of a banknote leaves the second sensor, to change the interval d between banknotes on the storage coiling block to 2d to eliminate the bump, where $\Delta t2=d/V_{constant\text{-}speed}$, and $V_{constant\text{-}speed}$ denotes a constant rotation linear speed of the storage coiling block.

* * * * *